US007476480B2

(12) United States Patent
Malachowski et al.

(10) Patent No.: US 7,476,480 B2
(45) Date of Patent: Jan. 13, 2009

(54) PROCESSES FOR PRODUCING TONER BY TREATMENT WITH ENZYME

(75) Inventors: Steven M. Malachowski, East Rochester, NY (US); Amy A. Grillo, Rochester, NY (US); Eugene F. Young, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 256 days.

(21) Appl. No.: 11/651,738

(22) Filed: Jan. 9, 2007

(65) Prior Publication Data

US 2007/0134579 A1 Jun. 14, 2007

Related U.S. Application Data

(63) Continuation-in-part of application No. 11/301,481, filed on Dec. 13, 2005.

(51) Int. Cl.
*G03G 9/08* (2006.01)

(52) U.S. Cl. ..... 430/108.1; 430/137.1; 430/137.14

(58) Field of Classification Search ..... 430/108.1, 430/137.1, 137.14
See application file for complete search history.

(56) References Cited

U.S. PATENT DOCUMENTS

| | | | | |
|---|---|---|---|---|
| 7,241,544 | B2 * | 7/2007 | Ohmura et al. | 430/108.3 |
| 2006/0046174 | A1 * | 3/2006 | Ohki et al. | 430/108.4 |
| 2006/0110674 | A1 * | 5/2006 | Maehata et al. | 430/109.3 |
| 2006/0263709 | A1 * | 11/2006 | Matsumura et al. | 430/105 |

* cited by examiner

*Primary Examiner*—John L Goodrow
(74) *Attorney, Agent, or Firm*—Annette L. Bade

(57) ABSTRACT

Herein is disclosed a process for producing emulsion aggregation toner including (i) adding a base to an emulsion aggregation toner to increase the pH of the toner to from about 7 to about 12; (ii) sieving and filtering the toner; (iii) washing the toner with an enzyme selected from the group consisting of carboxylic ester hydrolase and sulfuric ester hydrolase; (iv) filtering the toner; (v) washing the toner with reverse osmosis or deionized water; and (vi) adding an acid to reduce the pH of the toner to from about 3 to about 8.

18 Claims, No Drawings

PROCESSES FOR PRODUCING TONER BY TREATMENT WITH ENZYME

CROSS-REFERENCE TO RELATED APPLICATIONS

This application is a continuation-in-part of U.S. patent application Ser. No. 11/301,481, filed Dec. 13, 2005.

BACKGROUND

The present disclosure relates generally to toners and toner processes useful in electrostatographic apparatuses, and more specifically, to emulsion aggregation toner compositions treated with enzymes during processing.

Methods of preparing an emulsion aggregation (EA) type toner are known and toners may be formed by aggregating a colorant with a latex polymer formed by batch or semi-continuous emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process comprising: (i) conducting a pre-reaction monomer emulsification which comprises emulsification of the polymerization reagents of monomers, chain transfer agent, a disulfonate surfactant or surfactants, and optionally, an initiator, wherein the emulsification is accomplished at a low temperature of, for example, from about 5° C. to about 40° C.; (ii) preparing a seed particle latex by aqueous emulsion polymerization of a mixture comprised of (a) part of the monomer emulsion, from about 0.5 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

There exists a need to remove surfactants from the surfaces of the individual toner particles. One reason is because the presence of surfactants has been determined to have a detrimental affect on the charging of the toner, which ultimately hinders copy and print quality. Currently, the method of removing these surfactants incorporates a series of washes in a tank of reverse osmosis or deionized water, mixing with the use of an agitator, and then a dewatering step, such as centrifugation, pressure filtration, etc. This is a lengthy process. Therefore, a reduction in time for the process is desired. In addition, it is desired to provide a process that is environmentally friendly as compared to existing methods. Moreover, it is desired to provide a method that is more cost effective.

SUMMARY

Embodiments include a process for producing emulsion aggregation toner comprising (i) adding a base to an emulsion aggregation toner to increase the pH of the toner to from about 7 to about 12; (ii) sieving and filtering the toner; (iii) washing the toner with an enzyme selected from the group consisting of carboxylic ester hydrolase and sulfuric ester hydrolase to form a toner; (iv) filtering the toner; (v) washing the toner with reverse osmosis or deionized water; and (vi) adding an acid to reduce the pH of the toner to from about 3 to about 8.

Embodiments also include an emulsion aggregation toner comprising a resin, an enzyme, a colorant and at least one additive, said emulsion aggregation toner being prepared by a process comprising (i) adding a base to an emulsion aggregation toner to increase the pH of the toner to from about 7 to about 12; (ii) sieving and filtering the toner; (iii) washing the toner with an enzyme selected from the group consisting of carboxylic ester hydrolase and sulfuric ester hydrolase; (iv) filtering the toner; (v) washing the toner with reverse osmosis or deionized water; and (vi) adding an acid to reduce the pH of the toner to from about 3 to about 8.

In addition, embodiments include a process for producing emulsion aggregation developer comprising (i) adding a base to an emulsion aggregation toner to increase the pH of the toner to from about 7 to about 12; (ii) sieving and filtering the toner; (iii) washing the toner with an enzyme selected from the group consisting of carboxylic ester hydrolase and sulfuric ester hydrolase; (iv) filtering the toner; (v) washing the toner with reverse osmosis or deionized water; and (vi) adding an acid to reduce the pH of the toner to from about 3 to about 8, wherein said emulsion aggregation developer comprises carrier, and a toner comprising a resin, a colorant and at least one additive.

DETAILED DESCRIPTION

The present disclosure relates to processes for producing emulsion aggregation, whereby an enzyme is added to the emulsion aggregation toner slurry to aid in the removal of surfactants from the toner solids and the accompanying wash water in which the solids have been dispersed. Upon introduction of an enzyme into the chemical toner washing process, the enzyme acts as an organic catalyst in the decomposition of the surfactants that exist on the toner particles. The temperature and pH need to be at certain levels in order to provide the most favorable conditions for each specific enzyme to function. The enzymes intended for use are biodegradable, and this makes the process an ecologically safe alternative to existing methods. The addition of the enzyme significantly aids in the removal of surfactants off the particles and the accompanying wash water in which the solids have been dispersed. The use of an enzyme significantly reduces the time and cost through a reduction in the number of washes, and the amount of wastewater that is generated.

In embodiments, the toners may be emulsion aggregation-type toners that are prepared by the aggregation and fusion of latex resin particles with a colorant. After aggregation and coalescence, the toner is contacted with an enzyme during a washing process. In embodiments, "enzyme" refers for example, to any protein, conjugated protein, or fragment thereof produced by a living organism capable of functioning as a biochemical catalyst to promote the removal of surfactants. Suitable enzymes which may be used include enzyme classes such as hydrolases, ligases, lyases, oxido-reductases, transferases, isomerases, kinases or combinations thereof. Enzymes that may be used for cleaning include amylase, kinase, proteases, lipases, oxidase, reductase, catalase, pepsin, peptidase, trypsin, chymotrypsin, bromelain, papain, cymopapain, cellulose, cellulase, endoproteases, papyotin, endopeptidases, exopeptidases, or combinations thereof. In embodiments, the enzyme may be contained in an enzymatic cleaner which includes surfactants and natural protein enzymes, including those described above, derived from cereals such as wheat, oats, soy, barley, corn and other types of cereal grains, fruit and vegetable extracts such as grapes, carrots, pineapple, papaya and various other fruits and vegetables, and fermented carbohydrates. Suitable enzymatic cleaners include, for example, commercially available enzymatic cleaners such as Americos Protease XL, SEBrite-BP, Ecocare®, Naturzyme®—and combinations thereof. Specific examples of useful enzymes include carboxylic ester hydrolases and sulfuric ester hydrolases.

Resin

In embodiments, the latex which may be used in forming toner in accordance with the present disclosure includes, for example, submicron non-crosslinked resin particles in the size range of, for example, from about 50 to about 500 nanometers and in embodiments, from about 100 to about 400 nanometers in volume average diameter as determined, for example, by a Brookhaven nanosize particle analyzer. The non-crosslinked resin is generally present in the toner composition in an amount of from about 75 weight percent to about 98 weight percent, or from about 80 weight percent to about 95 weight percent of the toner or the solids of the toner. The expression "solids" can refer, in embodiments, to the latex, colorant, wax, metal additives, and any other optional additives of the toner composition. One or more additives may be included such as surfactants, coagulants, waxes, surface additives, charge control agents, and optionally mixtures thereof. In embodiments, "one or more" is from about 1 to about 20 or from about 3 to about 10.

In embodiments, the non-crosslinked resin in the latex is derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA), and the like.

In embodiments, the non-crosslinked resin of the latex may include at least one polymer. In embodiments, "at least one" is from about 1 to about 20 or from about 3 to about 10. Exemplary polymers include styrene acrylates, styrene butadienes, styrene methacrylates, and more specifically, poly (styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly (acrylonitrile-butyl acrylate-acrylic acid), and mixtures thereof. In embodiments, the polymer is poly(styrene/butyl acrylate/beta carboxyl ethyl acrylate). The polymer may be black, random, or alternating copolymers.

In embodiments, the latex may be prepared by a batch or a semicontinuous polymerization process resulting in submicron non-crosslinked resin particles suspended in an aqueous phase containing a surfactant. Surfactants that may be used in the latex dispersion can be ionic or nonionic surfactants in an amount of from about 0.01 to about 15, or from about 0.01 to about 5 weight percent of the solids.

Anionic surfactants that may be used include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments a suitable anionic surfactant is NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments, a suitable cationic surfactant includes SANISOL B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol available from Rhone-Poulenc as IGEPAL CA-210 ™, IGEPAL CA-520 ™, IGEPAL CA-720 ™, IGEPAL CO-890 ™, IGEPAL CO-720™, IGEPAL CO-290™, IGEPAL CA-210™, ANTAROX 890 ™ and ANTAROX 897™. In embodiments a suitable nonionic surfactant is ANTAROX 897 available from Rhone-Poulenc Inc., which is primarily an alkyl phenol ethoxylate.

In embodiments, the non-crosslinked resin may be prepared with initiators, such as water-soluble initiators and organic soluble initiators. Exemplary water-soluble initiators are ammonium and potassium persulfates and can be added in suitable amounts, such as from about 0.1 to about 8 weight percent or from about 0.2 to about 5 weight percent of the monomer. Examples of organic soluble initiators include Vazo peroxides, such as Vazo 64, 2-methyl2-2'-azobis propanenitrile, and Vazo 88, 2-2 '-azobis isobutyramide dehydrate in a suitable amount, such as from about 0.1 to about 8 percent, or from about 0.2 to about 5 weight percent of the monomer.

Known chain transfer agents can also be used to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, or from about 0.2 to about 10 percent by weight of the monomer.

Resin particles may also be produced by a polymer microsuspension process as disclosed in U.S. Pat. No. 3,674,736, the disclosure of which is hereby incorporated by reference in its entirety, polymer solution microsuspension process as disclosed in U.S. Pat. No. 5,290,654, the disclosure of which is hereby incorporated by reference in its entirety, mechanical grinding processes, or other known processes.

In embodiments, a gel latex may be added to the non-crosslinked latex resin suspended in the surfactant. A gel latex may refer in embodiments, for example, to a crosslinked resin or polymer, or mixtures thereof, or a non-crosslinked resin as described above that has been subjected to cross-linking.

The gel latex may include, for example, submicron crosslinked resin particles having a size of, for example, from about 10 to about 200 nanometers, or from about 20 to 100 nanometers in volume average diameter. The gel latex may be suspended in an aqueous phase of water containing a surfactant, wherein the surfactant is selected in an amount from about 0.5 to about 5 percent by weight of the solids, or from about 0.7 to about 2 percent by weight of the solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, or from about 0.5 to about 15 percent by weight of the crosslinked resin.

The crosslinked resin particles may be present in an amount of from about 0.1 to about 50 weight percent, or from about 1 to about 20 percent by weight of the toner.

In embodiments of the present disclosure, the gel latex may be a mixture of a crosslinked resin and a non-crosslinked resin.

The latex and optional gel latex may be added to a colorant and/or a wax to form a toner. In embodiments, the colorant may be in the form of a dispersion and the wax may also be in dispersion. The colorant dispersion includes, for example, submicron colorant particles having a size of, for example, from about 50 to about 500 nanometers and in embodiments, or from about 100 to about 400 nanometers in volume average diameter. The colorant particles may be suspended in an aqueous water phase containing an anionic surfactant, a nonionic surfactant, or mixtures thereof. In embodiments, the surfactant may be ionic and may be from about 1 to about 25 percent by weight, or from about 4 to about 15 percent by weight of the colorant.

Colorant

Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

The colorant may be present in the toner in an amount of from about 1 to about 25 percent by weight of toner, or from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

Wax

Where used, wax dispersions suitable for use in toners of the present disclosure include, for example, submicron wax particles having a size of from about 50 to about 500 nanometers, or from about 100 to about 400 nanometers in volume average diameter, suspended in an aqueous phase of water and an ionic surfactant, nonionic surfactant, or mixtures thereof. The ionic surfactant or nonionic surfactant may be present in an amount of from about 0.5 to about 10 percent by weight, or from about 1 to about 5 percent by weight of the wax.

The wax dispersion according to embodiments of the present disclosure includes a wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, pubic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, or from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, and in embodiments from about 2 to about 20 percent by weight of the toner.

The resultant blend of latex dispersion, optional gel latex dispersion, colorant dispersion, and optional wax dispersion may be stirred and heated to a temperature of from about 45° C. to about 65° C., in embodiments of from about 48° C. to about 63° C., resulting in toner aggregates of from about 4 microns to about 8 microns in volume average diameter, and in embodiments of from about 5 microns to about 7 microns in volume average diameter.

In embodiments, a coagulant may be added during or prior to aggregating the latex, the aqueous colorant dispersion, the optional wax dispersion and the optional gel latex. The coagulant may be added over a period of time from about 1 to about 5 minutes, in embodiments from about 1.25 to about 3 minutes.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 0.3 percent by weight of the toner, and in embodiments from about 0.05 to about 0.2 percent by weight of the toner.

Optionally, a second latex can be added to the aggregated particles. The second latex may include, for example, submicron non-crosslinked resin particles. The second latex may be added in an amount of from about 10 to about 40 percent by weight of the initial latex, and in embodiments in an amount of from about 15 to about 30 percent by weight of the initial latex, to form a shell or coating on the toner aggregates wherein the thickness of the shell is from about 200 to about 800 nanometers, and in embodiments from about 250 to about 750 nanometers.

In embodiments of the present disclosure, the latex and the second latex may be the same non-crosslinked resin.

In embodiments, the latex and the second latex may be different non-crosslinked resins.

Once the desired final size of the particles is achieved with a volume average diameter of from about 4 microns to about 9 microns, or from about 5.6 microns to about 8 microns, the pH of the mixture may be adjusted with a base to a value of from about 4 to about 7, from about 5 to about 7, or from about 6 to about 6.8. The base may include any suitable base such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, or from about 10 to about 20 percent by weight of the mixture.

The mixture is subsequently coalesced. Coalescing may include stirring and heating at a temperature of from about 90° C. to about 99° C., for a period of from about 0.5 to about 6 hours, or from about 2 to about 5 hours.

The pH of the mixture is then lowered to from about 3.5 to about 6 and, or from about 3.7 to about 5.5 with, for example, an acid to protonate and better coalesce the toner aggregates. Suitable acids include, for example, nitric acid, sulfuric acid, hydrochloric acid, citric acid or acetic acid. The amount of acid added may be from about 4 to about 30 percent by weight of the mixture, or from about 5 to about 15 percent by weight of the mixture.

The mixture is then cooled. Cooling may be at a temperature of from about 20° C. to about 40° C., or from about 22°

C. to about 30° C. over a period time from about 1 hour to about 8 hours, or from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., or from about 22° C. to about 30° C. Quenching may be feasible for small quantities of toner, such as, for example, less than about 2 liters, or from about 0.1 liters to about 1.5 liters. For larger scale processes, such as for example greater than about 10 liters in size, rapid cooling of the toner mixture is feasible and practical, either by the introduction of a cooling medium into the toner mixture, or by the use of jacketed reactor cooling.

The toner in the mixture is then further processed via wet sieving or filtering the mixture and the coalesced particles thereby obtained are washed and dried. The washing includes filtering and reslurrying a filter cake including toner particles with an enzyme, optionally in combination with reverse osmosis or deionized water. As noted above, suitable enzymes include lipases, kinases, proteases, peptidases, oxidases, reductases, pepsin, trypsin, bromelain, papain, cellulose, cellulase, endoproteases, papyotin, endopeptidases, exopeptidases, amylase, catalase, chymotrypsin, cymopapain, or combinations thereof. Prior to the addition of enzyme, the pH of the mixture is adjusted to from about 7 to about 12, or from about 9 to about 11. Typically, the pH is adjusted with a base such as sodium hydroxide, ammonia hydroxide, or the like. In embodiments, the base is added to a heated emulsion aggregation toner slurry. The emulsion aggregation toner slurry may be heated to a temperature of from about 20° C. to about 80° C. or from about 45° C. to about 65° C. Once the desired slurry temperature and pH have been obtained, the slurry is mixed for a period of time suitable to the enzyme in use. The slurry is then dewatered via pressure filtration, centrifugation, etc. In embodiments, the wet cake toner is then re-slurried in clean, reverse osmosis or deionized water, typically having a pH of from about 6 to about 9, or from about 7 to about 8.

The enzyme is then added in an amount of from about 1:25 to about 1:200 wt/wt enzyme to toner slurry with mixing for a period of time from about 1 to about 6 hours, in embodiments from about 2 to about 4 hours. In embodiments, the enzyme is added in an amount of from about 1:50 to about 1:150 wt/wt enzyme to toner slurry. It is assumed that small amounts of the enzyme remain in the toner with the majority of the enzyme being removed with the filtrate. The washing with enzyme may be at a temperature of from about 35° C. to about 65° C., or from about 40° C. to about 55° C. The mixture is then filtered, and the resulting filter cake is washed one or more times with reverse osmosis or deionized water, or from 1 to 6, or 2 to 4, 1 to 3 times. The pH may be reduced with an acid such as HCl, $HNO_3$ or other similar types during the washing with reverse osmosis or deionized water. The acid may reduce the pH to from about 3 to about 8, or from about 4 to about 5. The washing with reverse osmosis or deionized water may be at a temperature of from about 30° C. to about 70° C., or from about 35° C. to about 55° C.

In embodiments, the pH of coalesced toner slurry is adjusted with a base to about 8 to 10. Subsequently, the toner is filtered to produce a filter cake and the filter cake is washed by a single enzymatic cleaner wash, followed by one or more reverse osmosis or deionized water washes. During the reverse osmosis or deionized water wash, the pH of the slurry can be adjusted with an acid to about 4. In embodiments, 3 washes with reverse osmosis or deionized water may be used. In embodiments, the pH of the slurry is adjusted with an acid during the first wash with reverse osmosis or deionized water. After the total washing process, the enzyme is typically present in an amount of from about 0.1 to about 30, or from about 1 to about 10 percent by weight of the total toner composition.

Drying of the toner is typically carried out at a temperature of from about 35° C. to about 75° C., or from about 45° C. to about 60° C. for a period of time from about 1 hour to about 10 hours, or from about 2 hours to about 4 hours. The drying may be continued until the moisture level of the particles is below a set target of less than about 1 percent by weight, or less than about 0.7 percent by weight.

The toner may also include any known charge additives in amounts of from about 0.1 to about 10, or from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts; metal salts of fatty acids; silicas such as colloidal silicas, treated silicas and the like; metal oxides such as titanium oxide, zinc oxide and the like; strontium titanates; mixtures thereof; and the like. Surface additives may be present in an amount of from about 0.1 to about 10 weight percent, or from about 0.5 to about 7 weight percent of the toner. Example of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, or from about 0.1 to about 2percent of the toner, which additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light and developing the resulting latent electrostatic image by depositing toner on the image. The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, or from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins in close proximity in the triboelectric series, thermosetting resins, and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Emulsion aggregation toner would be prepared as follows. Toner slurry would be prepared by combining a latex dispersion including styrene/butylacrylate, a colorant dispersion, and a wax dispersion including, for example, polyethylene wax. The slurry would be aggregated, coalesced and then cooled to a temperature of about 60° C. Sodium hydroxide would be added to increase the pH from about 8 to about 10. The slurry would be mixed for about 20 minutes. An enzyme would be added to the slurry at about a 1:100 ratio, for example ABS Fungal Lipase L from American Biosystems Inc. The slurry would be mixed for a period of from about 1 to about 6 hours, then cooled. The slurry would be sieved through a vibratory sieve with a screen having pores of about 10-30 um, then dewatered through a filter having pores of about 0.5-3 um to form a wetcake. The wetcake would then be redispersed through the addition of reverse osmosis water using a water to toner ratio of about 6:1. The pH of this slurry would be adjusted down with Nitric acid to a pH from about 3 to about 5 and slurried for about 40 minutes. The slurry would then be dewatered again and then reslurried in a 6:1 ratio of fresh reverse osmosis water. The resulting slurry would then be dewatered and dried to a moisture content of less than about 0.7%.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for producing emulsion aggregation toner comprising:

(i) adding a base to an emulsion aggregation toner to increase the pH of the toner to from about 7 to about 12;

(ii) sieving and filtering the toner;

(iii) washing the toner with an enzyme selected from the group consisting of carboxylic ester hydrolase and sulfuric ester hydrolase to form a toner;

(iv) filtering the toner;

(v) washing the toner with reverse osmosis or deionized water; and (vi) adding an acid to reduce the pH of the toner to from about 3 to about 8.

2. A process in accordance with claim 1, wherein said enzyme is biodegradable.

3. A process in accordance with claim 1, wherein the enzyme is added in an amount from about 1:25 to about 1:200 wt/wt enzyme to toner.

4. A process in accordance with claim 3, wherein the enzyme is added in an amount from about 1:50 to about 1:150 wt/wt enzyme to toner.

5. A process in accordance with claim 1, wherein in (i) the pH is from about 9 to about 11.

6. The process according to claim 1, wherein in (i), the base is added at a temperature of from about 40 to about 80° C.

7. The process according to claim 6, wherein in (i), the base is added at a temperature of from about 45 to about 65° C.

8. The process according to claim 1, wherein in (iv), the pH is from about 4 to about 5.

9. The process in accordance with claim 1, wherein in (iv), the acid is added at a temperature of from about 30 to about 70° C.

10. An emulsion aggregation toner comprising a resin, an enzyme, a colorant and at least one additive, said emulsion aggregation toner being prepared by a process comprising:

(i) adding a base to an emulsion aggregation toner to increase the pH of the toner to from about 7 to about 12;

(ii) sieving and filtering the toner;

(iii) washing the toner with an enzyme selected from the group consisting of carboxylic ester hydrolase and sulfuric ester hydrolase;

(iv) filtering the toner;

(v) washing the toner with reverse osmosis or deionized water; and (vi) adding an acid to reduce the pH of the toner to from about 3 to about 8.

11. An emulsion aggregation toner in accordance with claim 10, wherein said resin is selected from the group consisting of styrenes, butadienes, isoprenes, acrylates, methacrylates, acrylonitriles, acrylic acid, methacrylic acid, itaconic or beta carboxy ethyl acrylate (β-CEA) and mixtures thereof.

12. An emulsion aggregation toner in accordance with claim 10, wherein said additive is selected from the group consisting of metal salts, colloidal silicas, metal oxides, strontium titanates, and mixtures thereof.

13. An emulsion aggregation toner in accordance with claim 12, wherein said additive is selected from the group consisting of titania, silica, strontium titanate and mixtures thereof.

14. An emulsion aggregation toner in accordance with claim 13, wherein said silica is treated silica.

15. An emulsion aggregation toner in accordance with claim 10, wherein said toner further comprises a wax.

16. An emulsion aggregation toner in accordance with claim 15, wherein said wax is selected from the group consisting of polyethylene and polypropylene waxes.

17. An emulsion aggregation toner in accordance with claim 16, wherein said wax is a polyethylene.

18. A process for producing emulsion aggregation developer comprising:

(i) adding a base to an emulsion aggregation toner to increase the pH of the toner to from about 7 to about 12;

(ii) sieving and filtering the toner;

(iii) washing the toner with an enzyme selected from the group consisting of carboxylic ester hydrolase and sulfuric ester hydrolase;

(iv) filtering the toner;

(v) washing the toner with reverse osmosis or deionized water; and (vi) adding an acid to reduce the pH of the toner to from about 3 to about 8, wherein said emulsion aggregation developer comprises carrier, and a toner comprising a resin, a colorant and at least one additive.

* * * * *